US008449214B1

(12) United States Patent
Shoberg

(10) Patent No.: US 8,449,214 B1
(45) Date of Patent: May 28, 2013

(54) CORNER PLASTER APPLICATOR

(76) Inventor: Donald Shoberg, Surprise, AZ (US)

( * ) Notice: Subject to any disclaimer, the term of this patent is extended or adjusted under 35 U.S.C. 154(b) by 489 days.

(21) Appl. No.: 12/814,469

(22) Filed: Jun. 13, 2010

(51) Int. Cl.
*B05C 11/00* (2006.01)

(52) U.S. Cl.
USPC ..... 401/266; 401/263; 401/179; 401/9

(58) Field of Classification Search
USPC ..... 401/48, 261, 263, 265, 266, 176, 401/179, 181, 9; 222/392
See application file for complete search history.

(56) References Cited

U.S. PATENT DOCUMENTS 3,231,139 A * 1/1966 Bouet ..... 222/95
6,120,203 A * 9/2000 Modders ..... 401/181
6,155,809 A * 12/2000 Edwards et al. ..... 425/87

OTHER PUBLICATIONS

MudRunner product for sale on tapetech.com website, available at http://www.tapetech.com/products/Corner-Applicators/MudRunner, website last visited Dec. 30, 2011.

* cited by examiner

*Primary Examiner* — David Walczak
(74) *Attorney, Agent, or Firm* — Adam R. Stephenson, Ltd.

(57) ABSTRACT

A plaster applicator for corners where walls meet includes a sleeve and a long tube slidably received within the sleeve. A piston is attached to the sleeve by a connector. The piston is concentrically received within the long tube whereby a sliding movement of the sleeve along the long tube provides a sliding movement of the piston within the long tube and vice versa. Further, the piston includes a gasket to prevents mud from leaking behind the piston. An applicator has a hole at an applicator end of the long tube. The hole provides liquid communication between the interior and the exterior of the long tube. A wedge is releasably mounted to the applicator.

9 Claims, 7 Drawing Sheets

CORNER PLASTER APPLICATOR

TECHNICAL FIELD

The present invention relates generally to plaster applicators, and, more particularly, to a plaster applicator for corners where two walls meet.

BACKGROUND OF THE INVENTION

Plaster is a material used as the outer surface of a wall in a structure. Plaster can be either plaster of paris, lime plaster or plaster. The base materials are mixed with water and other additives as desired to form a thick mixture of mud which initiates an exothermic chemical reaction which eventually hardens the mud into a solid form. Plastering of interior corners where two walls meet is presently a four step process. In the first step, a plasterer uses a tool called a bazooka which applies tape and mud to the corner. Next, the tape will be firmly seated using a corner roller. The third step is glazing using an angle head tool with the last step a repeat using an angle box.

In view of the prior art, there is a need for a more efficient and workable system which avoids the inefficiency of a four step plaster corner application process.

The present invention meets this need.

SUMMARY OF THE INVENTION

It is an object of this invention to provide a tool which allows for a one step process for applying plaster to a corner.

Further objects and advantages of the invention will become apparent as the following description proceeds and the features of novelty which characterize this invention will be pointed out with particularity in this specification and the claims below.

BRIEF DESCRIPTION OF THE DRAWINGS

The present invention may be more readily described by reference to the accompanying drawings in which.

DETAILED DESCRIPTION OF THE PREFERRED EMBODIMENT

Figure 1:
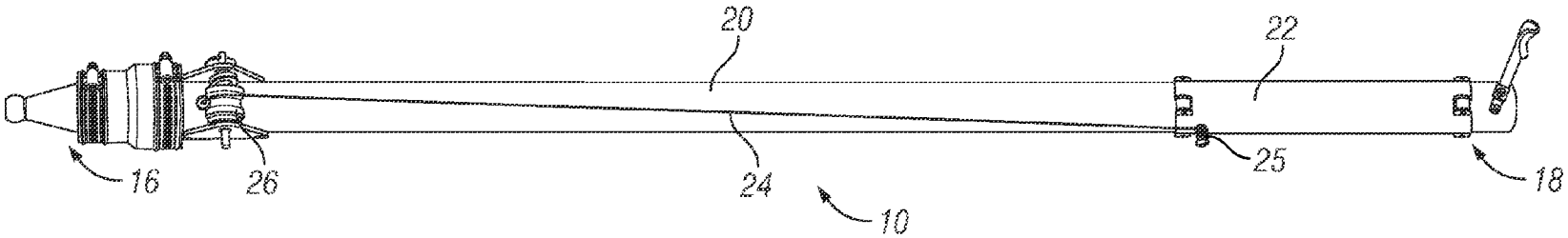
FIG. 1 is a side view of the present invention.

The present invention is a plaster applicator 10 for corners 12 where walls 14 meet. Plaster applicator 10 includes a sleeve 22 and a long tube 20 slidably received within sleeve 22. A piston 30 is attached to sleeve 22 by a connector 24. Piston 30 is concentrically received within long tube 20 whereby a sliding movement of sleeve 22 along long tube 20 provides a corresponding sliding movement of piston 30 within long tube 20 and vice versa. In addition, as best seen in FIG. 8, a gasket 31, preferably made of leather, is positioned on the top side of piston 30 to prevent leakage as described below.

An applicator 58 has a applicator hole 70 at an applicator end 16 of long tube 20. Applicator hole 70 provides liquid communication between the interior and the exterior of long tube 20. A wedge 66 is releasably mounted to the applicator 58

As shown in FIG. 1, applicator 10 is long tube 20 having an application end 16 and a grip end 18. Sleeve 22 slidably receives long tube 20 therein. Sleeve 22 is attached to connector 24, in the illustrated embodiment, a wire in the illustrated embodiment by a screw 25. Wire 24 extends from sleeve 22 to a pulley 26 mounted at application end 16. Wire 24 then enters the interior of long tube 20 via a hole 28 which is best seen in FIG. 8. The other end of wire 24 is attached to a piston 30 which is concentrically mounted within long tube 20.

Figure 2:
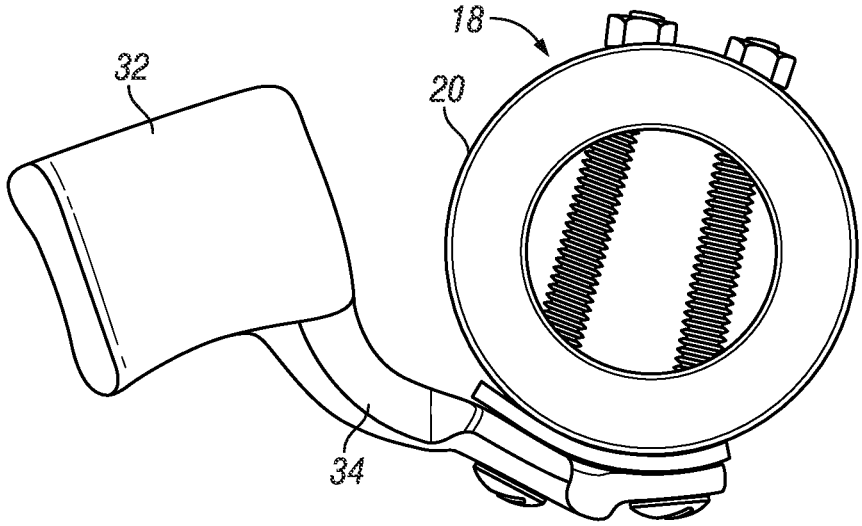
FIG. 2 is a bottom view of the present invention showing a hand grip.
Figure 8:
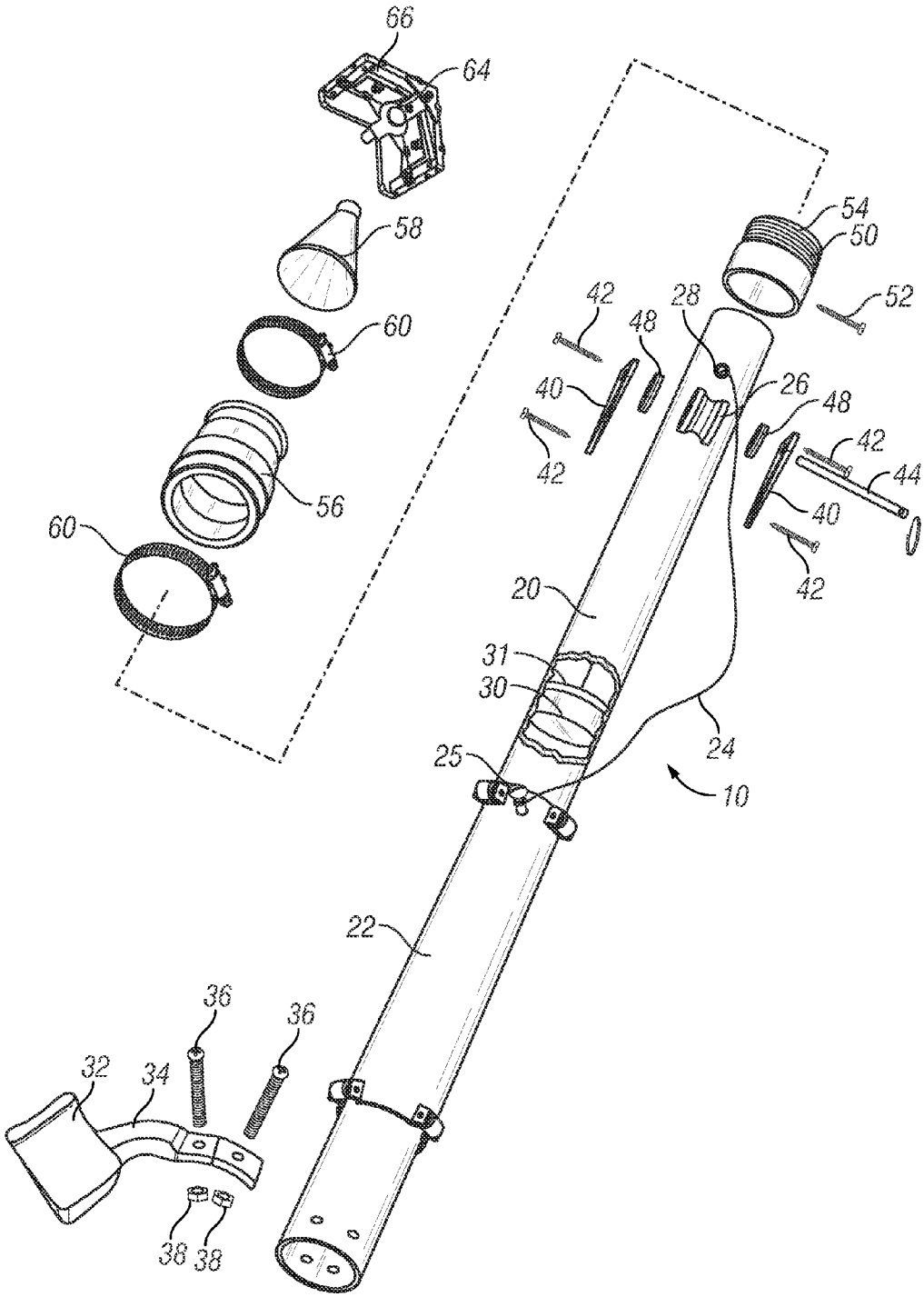
FIG. 8 is a cut away perspective view of the present invention; 2 is a side view of the present invention.

As best seen in FIGS. 2 and 8, a hand grip 32 is attached to a mounting bracket 34 which extends to long tube 20. Two bolts 36 extend through mounting bracket 34 through long tube 20 and are secured thereto by two corresponding nuts 38. A user employs hand grip 32 to hold the hand grip end 18 of applicator 10. Use of hand grip 32 is optional but does avoid having a user's fingers pinched by sleeve 22 when in use.

Figure 3:
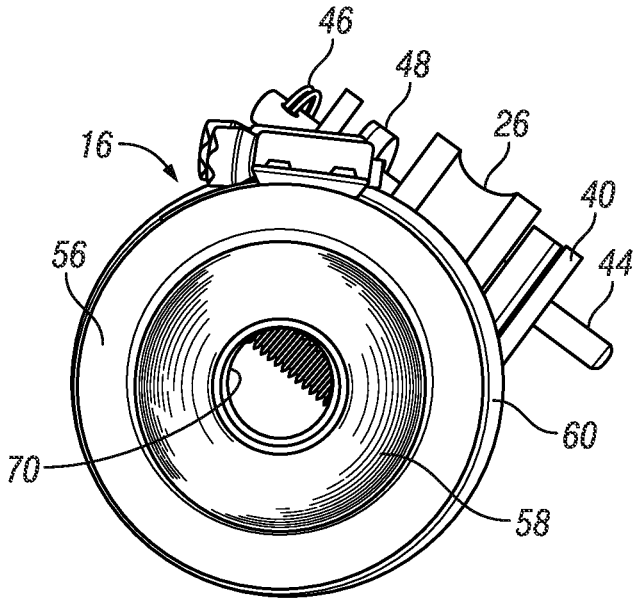
FIG. 3 is a top view showing the applicator end of the present invention.

As best seen in FIGS. 3 and 8, pulley 26 is mounted to long tube 20 between two mounting brackets 40 mounted to long tube 20 by screws 42. An axle 44 extends therebetween and is secured by circular pin 46. Bearings 48 are also mounted on either side of axle 44 to allow pulley 26 to freely rotate on axle 44.

As best seen in FIG. 8, at application end 16, an adapter 50 is mounted to application end 16 by a screw 52 which provides a threaded portion 54. A collar 56 has cone shaped applicator 58 mounted thereto which is secured thereto at threaded portion 54. Two hose clamps 60 are used to firmly secure collar 56 to both long tube 20 and applicator 58.

Applicator 58 includes a rounded top 62 which is adapted to releasably snap fit onto a wedge hole 64 in wedge 66. Rounded top 62 and wedge hole 64 allow wedge 66 to freely rotate and spin within limits defined by when wedge sides 68 engage applicator 58. Applicator hole 70 extends through rounded top 62 and provides liquid communication between the interior of long tube 20 and the exterior thereof.

To use, wedge 66 is first removed from applicator 58 thereby exposing applicator hole 70. Plaster mud 72 is then pumped into hole 70 thereby filling long tube 20 with said mud 72. As mud 72 fills long tube 20, piston 30 is pushed back to a filled position best seen in FIG. 4. In the filled position, piston 30 is situated at hand grip end 18 with wire 24 pulling sleeve 22 up to applicator end 16. Those skilled in the art will recognize that long tube 20 can be half filled if desired for small job.

Figure 4:
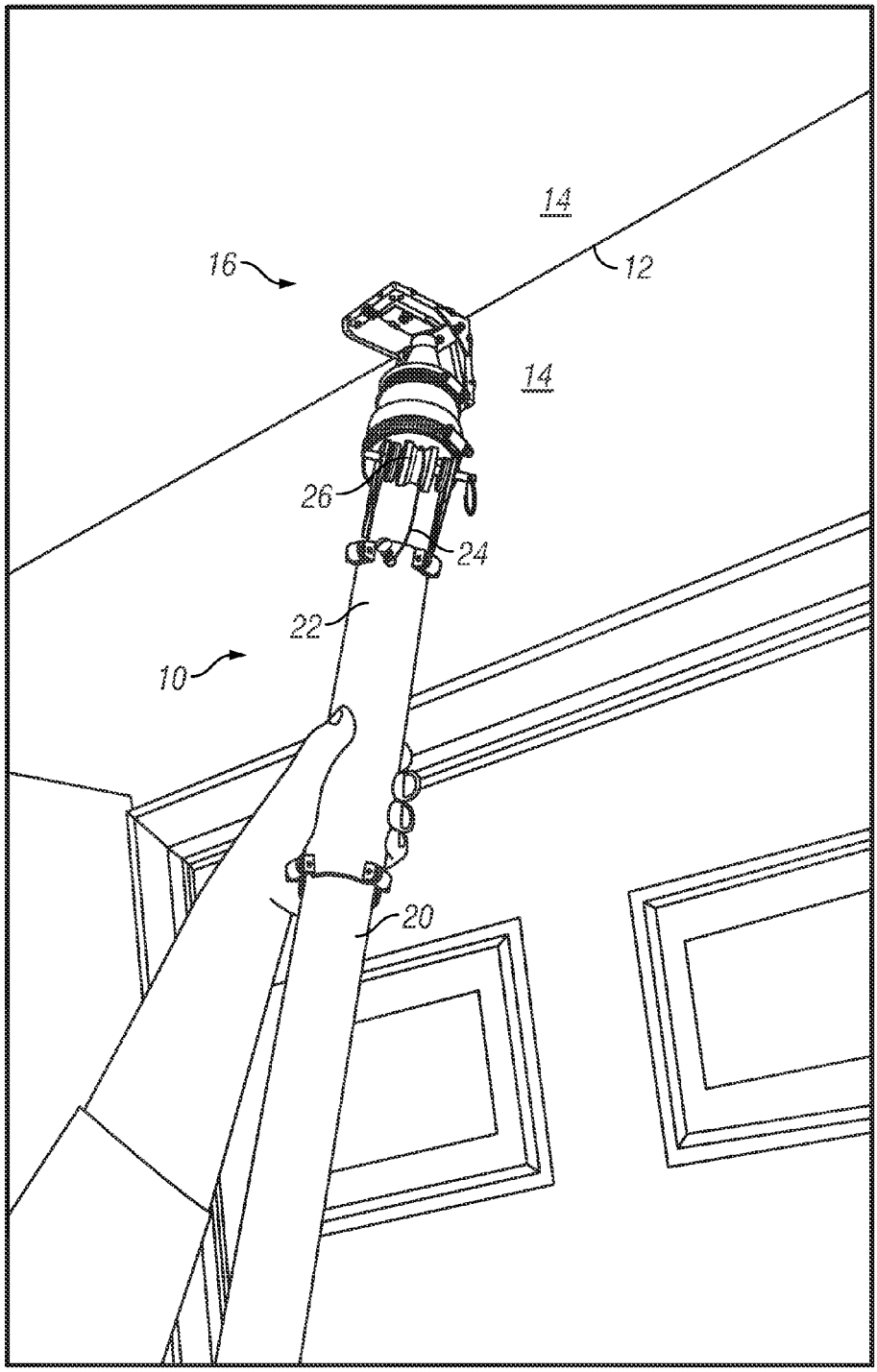
FIG. 4 is a perspective view of the present invention starting to apply plaster to a corner.
Figure 5:
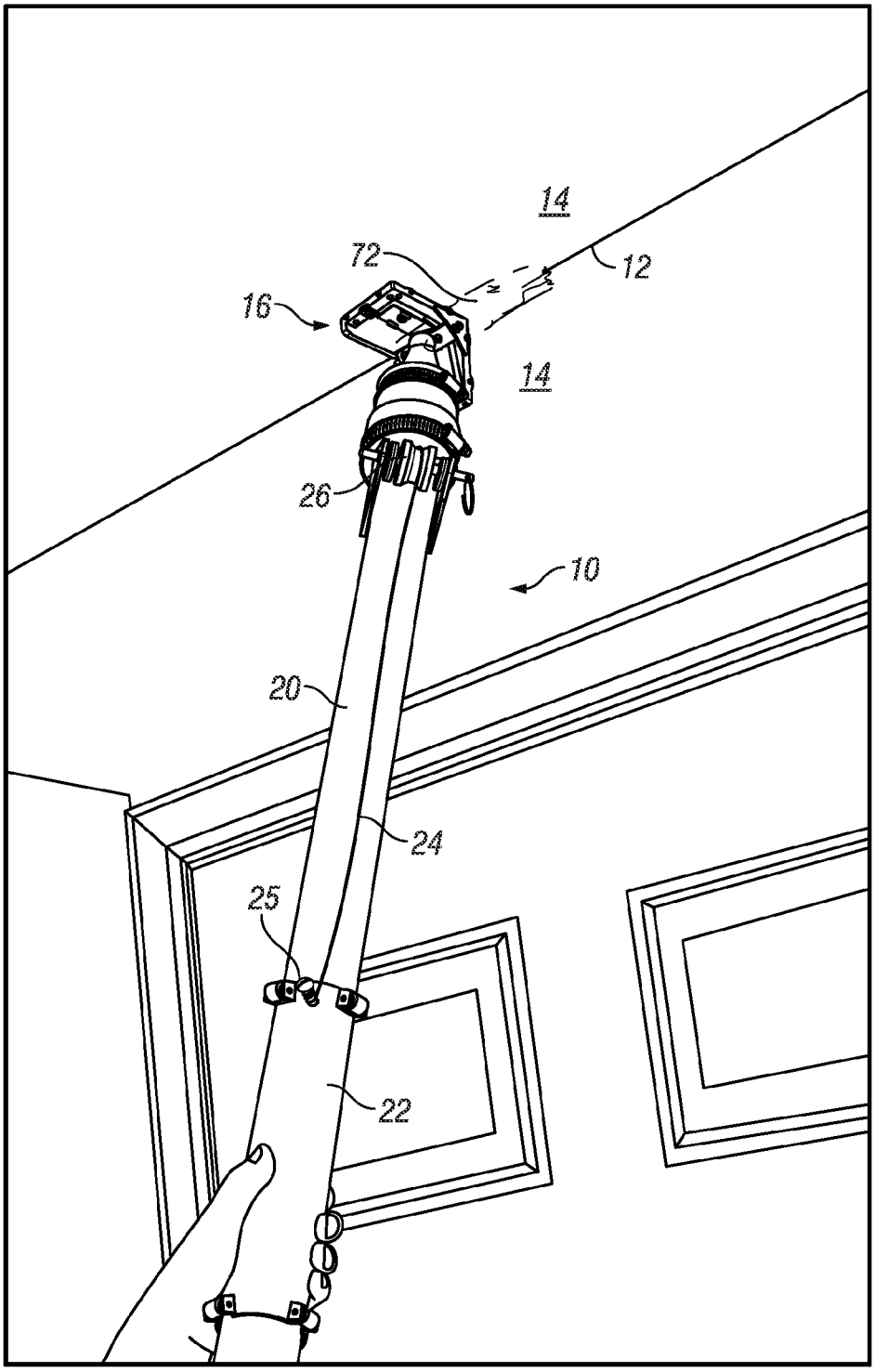
FIG. 5 is a perspective view of the present invention in the process of applying plaster to a corner.
Figure 6:
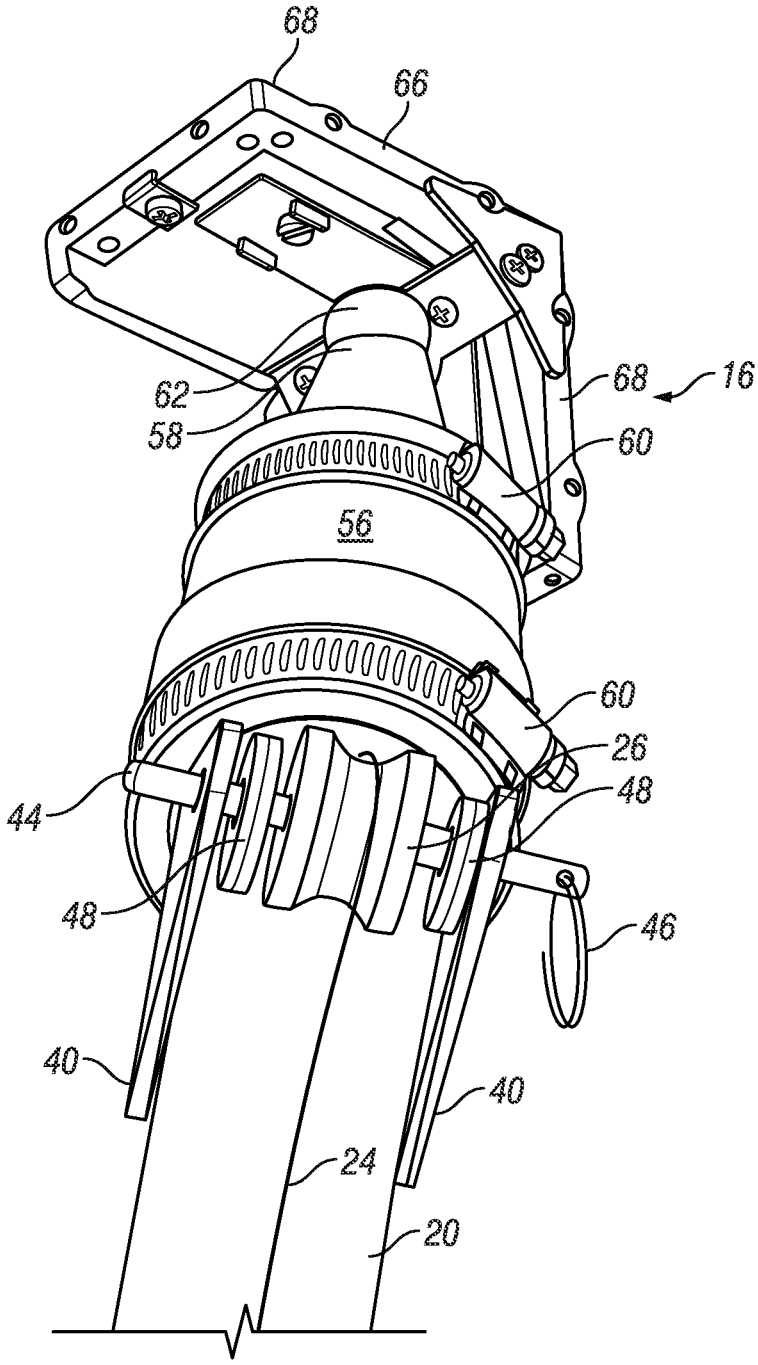
FIG. 6 is a close up perspective view of the application end of the present invention.
Figure 7:
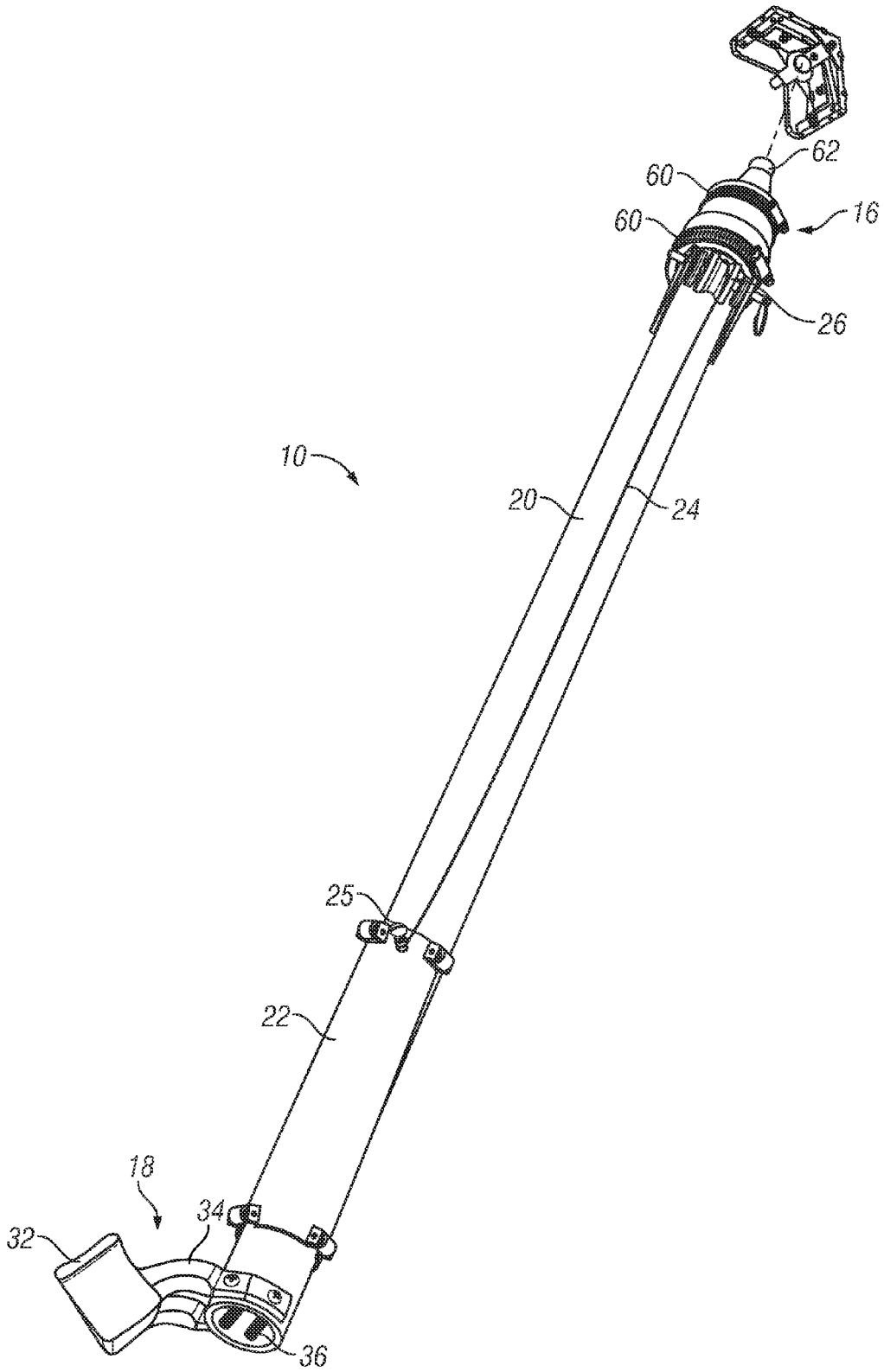
FIG. 7 is a perspective side view of the present invention showing a wedge detached from the device.

Once long tube 20 is filled as desired, wedge 66 is snap fit onto the top of applicator 58. To start, wedge 66 is positioned in a corner as best seen in FIG. 4 with one user's hand on hand grip 32 and the other grasping sleeve 22. To use, sleeve 22 is pulled towards hand grip end 18 while sliding wedge 66 along corner 12 as shown in FIG. 5. As shown, mud 72 is both applied by being pushed out of long tube 20 and smoothed by wedge 66 in one simple step. Gasket 31 prevents leakage of mud from the top of piston 30 into the portion of long tube 20 behind piston 30.

Those skilled in the art will recognize that the use of a right angle wedge 66 for right angle corner 12 is exemplary in nature that does not limit the type of corners to which applicator 10 can be mounted.

While the invention has been particularly shown and described with reference to a preferred embodiment. it will be understood by those skilled in the art that various changes in form and detail may be made therein without departing from the spirit and scope of the invention.

That which is claimed is:

1. A plaster applicator for corners where walls meet, the plaster applicator comprising:

a sleeve, a long tube slidably received within the sleeve, a piston attached to the sleeve by a connector, the piston being concentrically received within the long tube whereby a sliding movement of the sleeve along the long tube provides a sliding movement of the piston within the long tube and vice versa, the connector extending over a pulley mounted at the applicator end and extending through a hole in the long tube proximate to the pulley, an applicator having a hole at an applicator end of the long tube, the hole providing liquid communication between the interior and the exterior of the long tube; and a wedge being releasably mounted to the applicator.

2. The plaster applicator of claim 1 wherein the connector is a wire.

3. The plaster applicator of claim 1 further comprising a hand grip mounted on the long tube at a grip end opposite the applicator end.

4. The plaster applicator of claim 3 wherein the hand grip is mounted to a mounting bracket which is mounted on the long tube.

5. The plaster applicator of claim 1, wherein the applicator comprises a cone shaped applicator mounted to the applicator end of the long tube, the hole being positioned at the tip of the cone shaped applicator.

6. The plaster applicator of claim 5 wherein the cone shaped applicator has a rounded tip and the wedge releasably snap fits over the rounded tip.

7. The plaster applicator of claim 1 wherein a gasket is mounted to the piston thereby preventing liquid communication between the front and the rear of the piston.

8. A plaster applicator for corners where walls meet, the plaster applicator comprising:

a sleeve, a long tube slidably received within the sleeve, a piston attached to the sleeve by a connector, the connector extending over a pulley mounted at an applicator end of the long tube, the connector extending through a connector hole in the long tube proximate to the pulley, the piston being concentrically received within the long tube whereby a sliding movement of the sleeve along the long tube provides a sliding movement of the piston within the long tube and vice versa;

a cone shaped applicator having a rounded tip with an application hole positioned at the rounded tip, the cone shaped applicator being mounted at the applicator end of the long tube, the application hole providing liquid communication between the interior and the exterior of the long tube;

a wedge being releasably snap fit to the rounded tip of the cone shaped applicator;

a hand grip mounted to a mounting bracket which is mounted on the long tube at a grip end opposite the applicator end.

9. The plaster applicator of claim 8 wherein the connector is a wire.

* * * * *